United States Patent [19]

Wade

[11] 3,986,416

[45] Oct. 19, 1976

[54] SYNTHETIC FIBER CUTTING TOOL AND METHOD

[76] Inventor: Guy Wade, 3295 Brookdale, No. 11, Santa Clara, Calif. 95051

[22] Filed: May 19, 1975

[21] Appl. No.: 578,433

[52] U.S. Cl. ..... 83/1; 30/116; 83/5; 83/171; 219/227; 425/289; 425/383

[51] Int. Cl.[2] ..... B26F 3/12; H05B 3/44

[58] Field of Search ..... 219/221, 233, 227; 83/1, 171, 170, 15, 907, 925 R, 16, 651.1; 425/383, 289; 30/116, 140

[56] References Cited

UNITED STATES PATENTS

| | | | |
|---|---|---|---|
| 640,771 | 1/1900 | Johnson et al. | 219/233 |
| 1,954,061 | 4/1934 | Smith | 219/227 |
| 2,677,747 | 5/1954 | Jaye | 83/170 X |

FOREIGN PATENTS OR APPLICATIONS

| | | | |
|---|---|---|---|
| 4,427,430 | 8/1965 | Japan | 83/171 |

*Primary Examiner*—Othell M. Simpson
*Assistant Examiner*—W. D. Bray
*Attorney, Agent, or Firm*—Townsend and Townsend

[57] ABSTRACT

Apparatus and method for cutting a piece of synthetic fibrous material to a desired shape is disclosed. The apparatus includes an elongate heat resistive mounting structure having a shape conforming at least partially to the curvature of the desired shape. The mounting structure has an exposed face, and a resistor wire is embedded in this exposed face. Electric power is applied to the resistor wire so that the wire in the heat resistive mounting is heated to melt the synthetic fibrous material as the mounting structure is moved therethrough to cut the material to the desired shape.

8 Claims, 4 Drawing Figures

3

SYNTHETIC FIBER CUTTING TOOL AND METHOD

BACKGROUND OF THE INVENTION

The present invention relates to cutting tools, and in particular to an apparatus and method for cutting a block of synthetic fibrous material to a desired shape.

It has been found desirable to construct a variety of different types of articles such as furniture pieces out of foam rubber or other synthetic fibrous materials. The foam rubber is cut to the basic shape of the article, and is then encapsulated with a fabric or other type of covering to provide the finished article. A wide variety of interesting and attractive articles can be constructed in this manner at relatively low cost.

One of the principal problems in constructing various furniture pieces and other articles in the above manner is cutting the foam rubber or other such material to the desired shape. It has been found that foam rubber can easily be cut by a heated wire, and it has become the common practice in the art to cut the rubber to the desired shape by holding such a wire taut, and making a plurality of cuts until the desired shape has been achieved. However, because the taut wire is necessarily linear, the number of shapes which can be cut from the foam rubber in this manner is seriously limited.

When relatively complex shapes are to be formed in foam rubber or other such material, it has been found useful to employ a relatively large diameter, stiff wire which can be formed to the desired shape, as illustrated in the patent to Rowlands, U.S. Pat. No. 3,610,078. However, such a heavy wire is difficult to construct in the desired shape, and is relatively expensive. Thus, the use of such a heavy wire is ordinarily commercially unfeasible in the production of furniture and other relatively low priced items. It should be noted that the Rowland patent deals with the making of foam rubber packing inserts for relatively expensive aircraft engine parts where cost is not a prohibitive factor.

SUMMARY OF THE INVENTION

The present invention provides an apparatus and method for cutting a piece of synthetic fibrous material to a desired shape. The apparatus includes an elongate heat resistive mounting structure having a shape conforming at least partially to the curvature of the desired shape. The mounting structure has an exposed face, and a resistor wire is embedded in this exposed face. Electric power is applied to the resistor so that the wire in the heat resistive mounting is heated to melt synthetic fibrous material as the mounting structure is moved therethrough to cut the material to the desired shape.

With the apparatus of the present invention, relatively complex shapes can easily be formed in the fibrous material. In addition, the apparatus of the present invention can be constructed at relatively low cost and with a minimum of labor so that the cost of constructing the apparatus and its use in cutting complex shapes is commercially feasible.

In one embodiment of the present invention, the apparatus is adapted to cut the fibrous material into the shape of a body of revolution. To this end, a rod is inserted into the material at the axis of the body of revolution, and the ends of the mounting structure or its support structure are rotatably connected to the rod. The apparatus can then be rotated to cut the fibrous material into the desired shape of the body of revolution. In addition, more complex shapes can be constructed using two or more apparatus constructed according to the teachings of the present invention by employing them serially to cut the fibrous material to the desired shape.

The novel features which are believed to be characteristic of the invention, both as to organization and method of operation, together with further objects and advantages thereof will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

The apparatus of the present invention is used to cut a block 10 of synthetic fibrous material such as foam rubber to a desired shape. In the embodiment illustrated, a first cut is made with cutting tool 12 which cuts the block 10 into a first shape 14 and a second shape 16, both of which are bodies of revolution, and leaves a relatively small amount of scrap material around the edges. Shape 16 is used to construct a hassock, and shape 14 is subjected to a second cut to provide the foundation for a chair.

Figure 1:
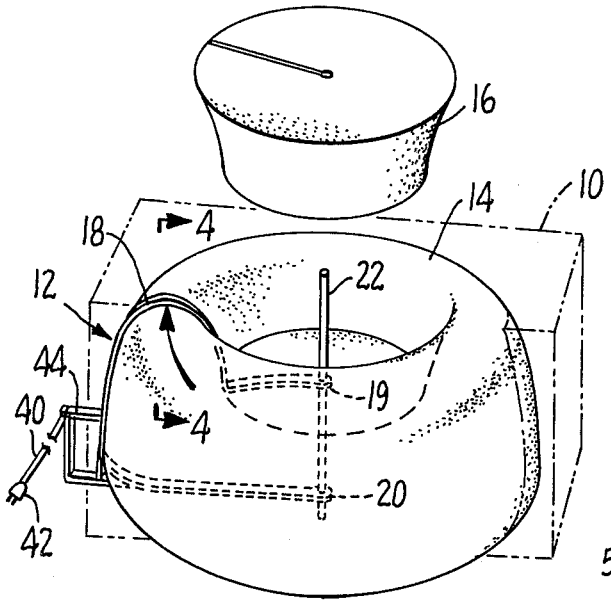
FIG. 1 is a perspective view of a preferred embodiment of the present invention used to make the preliminary cut in the fibrous material in the formation of a chair.

In order to form the two bodies of revolution 14, 16 out of block 10 of fibrous material, cutting tool 12 is first inserted into block 10 as illustrated in FIG. 1. Cutting tool 12 includes an elongate curved support structure 18 which is shaped to conform to the curvature of the desired bodies of revolution. The free ends 19, 20 of support structure 18 include a juxtaposed pair of rings disposed along a common axis, and cutting tool 12 is inserted into block 10 until the rings at the ends 19, 20 of the cutting tool are coincident with the axis of revolution of the shapes to be formed. A rod 22 is then inserted through support structure 18 along the axis of the shapes to be formed and engages the rings at the ends 19, 20 of support structure 18.

Figure 4:
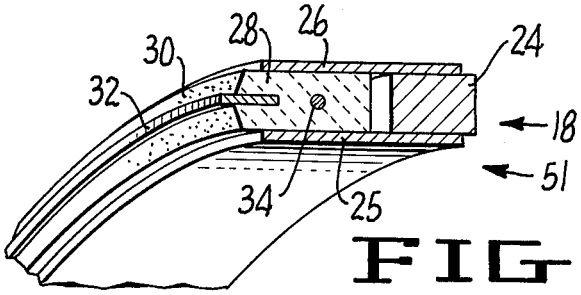
FIG. 4 is a fragmentary sectional view of the cutting edge of the apparatus of the present invention taken along lines 4—4 of FIG. 1 and/or 3.

Support structures 18 of cutting tool 12 is provided with a cutting edge along a portion of its length as illustrated in detail in FIG. 4. Support structure 18 includes a metallic strut 24 which extends the entire length of the support. A pair of parallel plates 25, 26 are disposed on either side of and fixed to strut 24 along the length of strut 24 provided with the cutting edge. A heat resistive mounting structure 28 is fixed between plates 25, 26 and includes an exposed face 30 having a V-shaped configuration. Heat resistive mounting structure 28 is preferably constructed of ceramic material but can be formed from other types of heat resistant material as well.

A resistor wire 32 is embedded in the exposed face 30 of heat resistive mounting structure 28 at the apex of the V-shape. Resistor wire 32 is preferably a nicron wire, comprising 20% nickel and 80% chromium, but other types of resistor wires could be used as well. Wire conductor 34 is embedded in heat resistive mounting structure 28 and is attached to the far end of resistor wire 32.

Referring back to FIG. 1, the cutting edge illustrated in FIG. 4 is disposed along the length of support structure 18 which is used to cut the fibrous material. A cord 40 projects from the cutting edge, and includes wires connected to the wire 34 embedded in the cutting edge and to the near end of resistor wire 34. A plug 42 at the end of cord 40 is connected to a source of electrical power to heat the resistor wire 32. With the resistor wire heated, cutting tool 12 can be grasped at its handle 44 and rotated about rod 22 to cut the block 10 of fibrous material into bodies of revolution 14, 16.

The shape 16 cut from block 10 of fibrous material can be covered as is to provide a hassock. However, in order to form the other shape 14 into a chair, a second cutting step is required, as illustrated in FIG. 2.

Figure 2:
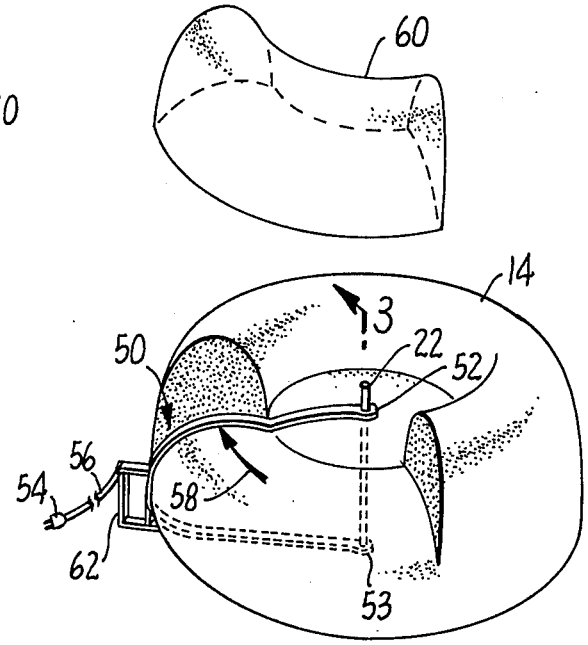
FIG. 2 is a perspective view of a further embodiment of the present invention used to make a final cut in constructing the chair of FIG. 1.
Figure 3:
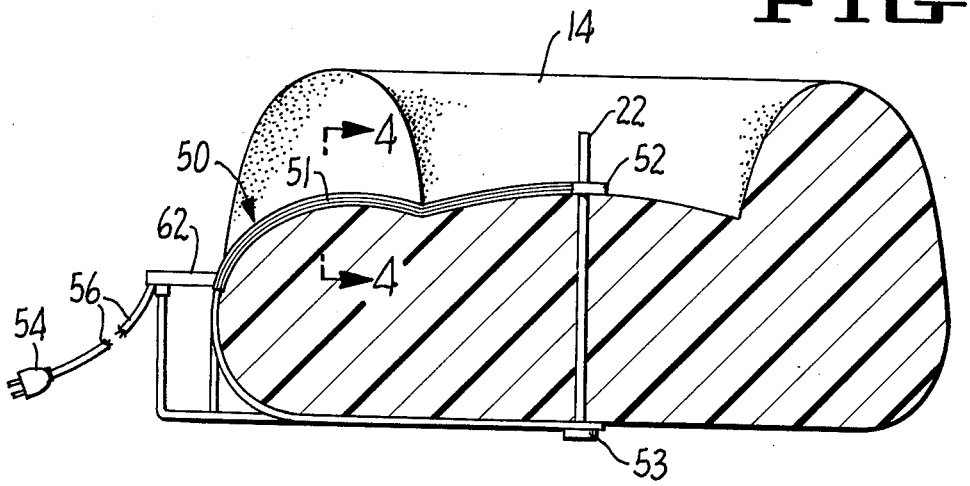
FIG. 3 is a perspective view taken along lines 3—3 of FIG. 2.

To perform the cutting step illustrated in FIG. 2, a second cutting tool 50, generally similar in construction to cutting tool 18, but having a different shape, is inserted through the sidewalls of shape 14 (See FIG. 3). As before, cutting tool 50 is provided with juxtaposed rings 52, 53 at its opposite ends which are engaged by rod 22. Cutting tool 50 is provided with a cutting edge 51 along that portion of its length which intersects the sidewall of shape 14. The cutting edge of tool 50 is similar to that of tool 12, as illustrated in FIG. 4. The plug 54 at the end of cord 56 leading to the resistor wire in the cutting edge is engaged with a source of electrical power, and cutting tool 50 is rotated using handle 62 through an arc of approximately 90° as illustrated by arrow 58 to cut a portion 60 of the sidewall of shape 14 from the basic shape. (It should be noted that section 60 is a portion of a body of revolution having an axis or rotation coincident with rod 22.) Shape 14 with portion 60 removed can then be covered to provide a chair.

While preferred embodiments of the present invention have been illustrated in detail, it is apparent that modifications and adaptations of those embodiments will occur to those skilled in the art. In particular, such adaptations of the present invention can be used to form furniture articles having different shapes which may or may not be bodies of revolution, and in the formation of a wide variety of different types of articles other than furniture. However, it is to be expressly understood that such modifications and adaptations are within the spirit and scope of the present invention, as set forth in the following claims.

I claim:

1. Apparatus for cutting a piece of synthetic material to a desired shape, said apparatus comprising:

an elongate heat resistive mounting structure conformed at least partially to the desired shape and having an exposed face;

a resistor element embedded in the exposed face of the heat resistive mounting structure;

a conductor embedded in the heat resistive mounting structure and connected at one end to the resistor element; and means for applying electric power to the resistor element through the conductor so that said resistor element is heated to melt the synthetic material as the mounting structure is moved therethrough to cut the material to the desired shape.

2. Apparatus as recited in claim 1 and additionally comprising an elongate support structure conformed at least partially to the desired shape, and wherein said heat resistive mounting structure is fixed to the elongate support structure along at least a portion of its length.

3. Apparatus as recited in claim 2 wherein the desired shape is at least partially a body of revolution, and additionally comprising a rod insertable through the material along the axis of the body of revolution and means at the end of the support structure for connecting the ends of said support structure rotatably to the rod so that the support structure can be rotated about said rod as electric power is applied to the resistor wire to cut the material to the desired shape.

4. Apparatus as recited in claim 1 wherein said resistor wire comprises a nicron wire.

5. A method of cutting a piece of synthetic fibrous material to a desired shape which is at least partially a body of revolution, said method comprising the steps of:

inserting a rod through said material at a position coincident with the axis of the body of revolution;

attaching the opposite ends of a curved support structure having an exposed resistor wire rotatably to the rod; and applying electric power to the resistor wire and simultaneously rotating the support structure about the rod to cut the material at least partially into the shape of a body of revolution.

6. Apparatus for cutting a piece of synthetic fibrous material to a desired shape which is at least partially a body of revolution, said apparatus comprising:

a rod adapted to be inserted through the fibrous material coincident with the axis of the body of revolution;

an elongate support structure conformed at least partially to the curvature of the desired shape;

means at the ends of the support structure for rotatably attaching said support structure to the rod so that the structure can be rotated about said rod;

an elongate heat resistive mounting structure fixed to the elongate support structure along at least a portion of its length and including an exposed face having a generally V-shaped configuration;

a resistor wire embedded in the exposed face of the heat resistive mounting structure at the focus of said V-shape; and means for applying electric power to the resistor wire so that said resistor wire is heated to melt the synthetic fibrous material as the support structure is rotated about the rod to cut the material to the desired shape.

7. Apparatus for cutting a piece of synthetic material to a desired shape, said apparatus comprising:

an elongate heat resistive mounting structure conformed at least partially to the desired shape and having an exposed face;

a resistor element embedded in the exposed face of the heat resistive mounting structure;

an elongate support structure conformed at least partially to the desired shape, and wherein said heat resistive mounting structure is fixed to the elongate support structure along at least a portion of its length; and means for applying electric power to the resistor element so that said resistor element is heated to melt the material as the support structure is moved therethrough to cut the material to the desired shape.

8. Apparatus as recited in claim 7 wherein the desired shape is at least partially a body of revolution, and additionally comprising a rod insertable through the material along the axis of the body of revolution and means at the ends of the support structure for connecting the ends of said support structure rotatably to the rod so that the support structure can be rotated about said rod as electric power is applied to the resistor element to cut the material to the desired shape.

* * * * *